US007380900B2

(12) United States Patent
Kanda et al.

(10) Patent No.: US 7,380,900 B2
(45) Date of Patent: Jun. 3, 2008

(54) IMAGING FORMING SYSTEM, PRINT CONTROL METHOD AND CONTROL PROGRAM FOR PRINTING APPARATUS

(75) Inventors: Hidehiko Kanda, Yokohama (JP); Aya Hayashi, Sendai (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 11/397,611

(22) Filed: Apr. 5, 2006

(65) Prior Publication Data

US 2006/0274096 A1 Dec. 7, 2006

(30) Foreign Application Priority Data

Apr. 8, 2005 (JP) ..... 2005-112470

(51) Int. Cl.
*B41J 29/393* (2006.01)

(52) U.S. Cl. ..... 347/19; 347/84

(58) Field of Classification Search ..... 347/19, 347/84–86, 14; 358/1.2, 1.9
See application file for complete search history.

(56) References Cited

U.S. PATENT DOCUMENTS 5,975,673 A * 11/1999 Ohtsuka et al. ..... 347/15
6,062,671 A 5/2000 Kanda et al. ..... 347/30
6,231,167 B1 5/2001 Tsuboi et al. ..... 347/65
2003/0051904 A1* 3/2003 Aruga ..... 174/255

FOREIGN PATENT DOCUMENTS

| | | |
|---|---|---|
| JP | 7-032606 | 2/1995 |
| JP | 2002-059569 | 2/2002 |
| JP | 2004-188762 | 7/2004 |

* cited by examiner

*Primary Examiner*—Lamson D. Nguyen
(74) *Attorney, Agent, or Firm*—Fitzpatrick, Cella, Harper & Scinto

(57) ABSTRACT

An image forming system includes: a computer for supplying image data; and a printer having a sub-tank for retaining ink to be supplied to a printing head and a system performing an on-demand supply of ink to the sub-tank. With the image forming system, during printing, the occurrence of a fuzzy image, due to ink in the sub-tank being exhausted, is prevented, and a reduction in the throughput of printing is also prevented. The computer counts, in advance, dots required for the printing of image data, and transmits the dot count, as well as image data, to the printer. The printer compares the amount of ink in the sub-tank with the required ink amount that based on the received dot counts. Only when it is determined that the remaining ink amount is insufficient, refilling of the sub-tank is performed, and thereafter, the printing of the image data is performed.

8 Claims, 13 Drawing Sheets

| | BLACK | CYAN | MAGENTA | YELLOW |
|---|---|---|---|---|
| PHOTOPRINTING MEDIUM | 0 | 34560000 | 34560000 | 34560000 |

UNIT:DOT

FIG.9

IMAGING FORMING SYSTEM, PRINT CONTROL METHOD AND CONTROL PROGRAM FOR PRINTING APPARATUS

BACKGROUND OF THE INVENTION

1. Field of the Invention

The present invention relates to an image forming system, a print control method and a control program for a printing apparatus. The present invention is particularly appropriate for an image forming system that employs an ink jet printing apparatus.

2. Description of the Related Art

As an ink supply system for supplying ink a printing head applied to an ink jet printing apparatus, there has been one which has a reservoir for reserving a predetermined amount of ink to be supplied to the printing head, and in which the ink is supplied from an ink supply source to the reservoir when necessary. Such an ink supply system is hereinafter called an on-demand supply system. The ink supply source used for this system is referred to as a main tank or a first ink tank, and the reservoir for retaining a predetermined amount of ink is referred to as a sub-tank or a second ink tank. For example, while the on-demand supply system applied for a serial scan type ink jet printing apparatus has a comparatively small sub-tank and a printing head mounted on a carriage, the on-demand supply has a comparatively large main tank located at a location other than on the carriage of the printing apparatus. Further, the supply system is so constituted that as an amount of ink in the sub-tank is reduced, the ink is replenished from the main tank to the sub-tank at an appropriate timing. Furthermore, a constitution is adopted, in which, during main scanning, by separating an ink supply path between the main tank and the sub-tank spatially, or by closing an ink channel therebetween by using a valve, for example, the first and the second ink tanks are fluidically isolated.

As a method for controlling a ink replenishment timing in the ink j et printing apparatus adopting such an on-demand supply system, there has been one disclosed in Japanese Patent Application Laid-Open No. 7-32606 (1995). According to this method, the number of droplets (dots) are counted based on image data that has been received by a printing apparatus (an ink jet printer) prior to printing. In accordance with the resulting count value, a predicted amount of ink to be used is calculated, and the calculated value is compared with the amount of ink currently remaining in a sub-tank. When the amount of ink in the sub-tank is smaller, ink is supplied (the sub-tank is refilled).

According to a control method disclosed in Japanese Patent Application Laid-Open No. 2002-59569, before compressed image data is expanded for printing, the amount of ink required for the printing is predicted based on the compression parameters of the compressed image data. Then, the predicted amount of ink is compared with the amount of ink currently remaining in a sub-tank, and when the amount of ink remaining in the sub-tank is smaller, ink is supplied.

According to a method disclosed in Japanese Patent Application Laid-Open No. 7-32606 (1995), since the number of droplets for all the image data to be printed by the printing apparatus are added up, the image data must be expanded from various file forms to obtain a printable form before the addition-up of the number of the droplets. Thus, a considerable period of time is required. Further, in order to increase an expansion process speed, there has been either a method of employing a high-speed CPU or a method of executing a parallel process. Neither of these, however, is a preferable measure, because these methods cause arise in the manufacturing costs for a printing apparatus, a complicated configuration thereof and am increase in a size thereof. Furthermore, since data transmitted by an apparatus that serves an image data supply source to the recoding apparatus must once be temporarily expanded in a memory, a large capacity memory is also required. This factor also greatly affects the manufacturing costs and the size of the main body of the printing apparatus.

Small size and low price tend to be desired for a serial scanning printing apparatus. Generally, therefore, instead of a large memory being mounted, a memory buffer having a comparatively small capacity is provided, and a configuration which performs the following processes is employed.

These processes include:

receiving compressed data;

initiating data printing when a predetermined amount of data has been received and expanded in a buffer of a main body;

when printing for one scanning has been completed, releasing the buffer in which data for the pertinent scanning has accumulated; and expanding, in the released buffer, newly received compressed data.

According to this printing apparatus, the number of all the dots to be printed on a current page is not determined until printing has completed. The method described in Japanese Patent Application Laid-Open No. 7-32606 (1995), therefore, in which the ink to be supplied to the sub-tank is determined after all the data for a page to be printed have been developed, is not a practical resolution.

According to the method described in Japanese Patent Application Laid-Open No. 2002-59569, before the expansion of all image data that are compressed by analyzing the image data parameters, the amount of ink required to print all of the image data is predicted. Thus, the predicted amount may differ from an amount of ink actually required for printing. During printing, no more ink remains in the sub tank (the ink is exhausted), a fuzzy image may be output. In order to avoid this phenomenon, when the maximum required amount of ink is predicted, the ink refilling operation from the main tank to the sub-tank is performed frequently, even though the ink sufficient for recoding remains in the sub-tank. Accordingly, the printing throughput is deteriorated. Especially when addresses are printed on multiple cards and envelopes, and when characters, such as for documents, are printed on plain paper, the amount of ink required for printing varies greatly in accordance with the type, the size, the interval and the number of characters to be printed. Therefore, it is difficult to accurately predict the amount of ink actually required for printing. This is true because, simply speaking, between a document consisting of one character and a document consisting of 100 characters, there is a difference of about 100 times in the amount of ink required for printing.

SUMMARY OF THE INVENTION

The present invention is appropriate for a printing apparatus configured to be small and inexpensive, which has a memory buffer that has a comparatively small capacity. One objective of the present invention is to prevent, for such a printing apparatus, the occurrence of fuzzy images due to the exhaust of ink in a sub-tank during printing, and to appropriately time the refilling of the sub-tank with ink, thus preventing a reduction in the printing throughput.

In a first aspect of the present invention, there is provided an image forming system comprising:

an image data supply apparatus for supplying image data; and a printing apparatus for, based on the received image data, employing an ink jet printing head to perform printing, wherein the image data supply apparatus includes:

means for generating information that corresponds to an amount of ink to be used for printing an image data as an image on a printing medium based on the image data; and means for transmitting the generated information, as well as the image data, to the printing apparatus, and wherein the printing apparatus includes:

a main tank, which serves as a source for supplying ink to the ink jet printing head;

a sub-tank for receiving ink from the main tank, and for supplying the ink to the ink jet printing head;

means for supplying ink from the main tank to the sub-tank;

means for detecting the amount of ink in the sub-tank;

means for receiving the information and the image data; and means for, prior to printing the image data, based on the received information and the amount of ink in the sub-tank, detected by the detecting means, determining whether the supply of ink by the ink supplying means should be performed.

In a second aspect of the present invention, there is provided a print control method for an image forming system comprising:

an image data supply apparatus for supplying image data; and a printing apparatus for, based on the received image data, employing an ink jet printing head to perform printing, including a main tank, which serves as a source for supplying ink to the ink jet printing head, a sub-tank for receiving ink from the main tank, and for supplying the ink to the ink jet printing head, and means for supplying ink from the main tank to the sub-tank;

the method comprising the steps of:

generating information that corresponds to an amount of ink to be used for printing the image data as an image on a printing medium based on the image data;

transmitting the generated information, as well as the image data, to the printing apparatus from the image data supply apparatus,;

detecting the amount of ink in the sub-tank at the printing apparatus;

receiving the information and the image data at the printing apparatus; and prior to printing the image data, based on the received information and the amount of ink in the sub-tank, detected by the detecting step, determining whether the supply of ink by the ink supplying means should be performed, at the printing apparatus.

In a third aspect of the present invention, there is provided a control method for a printing apparatus for, based on supplied image data, employing an ink jet printing head to perform printing, including a main tank, which serves as a source for supplying ink to the ink jet printing head, a sub-tank for receiving ink from the main tank, means for detecting the amount of ink in the sub-tank and for supplying the ink to the ink jet printing head, means for detecting the amount of ink in the sub-tank and means for supplying ink from the main tank to the sub-tank;

the method comprising the steps of:

generating information that corresponds to an amount of ink to be used for printing the image data as an image on a printing medium based on the image data; and transmitting the generated information, as well as the image data, to the printing apparatus from the image data supply apparatus,;

wherein the printing apparatus is capable of, prior to printing the image data, based on the received information and the amount of ink in the sub-tank detected by the detecting means, determination whether the supply of ink by the ink supplying means should be performed.

The above system or method may further comprise means for or the step of analyzing an image information parameter required for printing the image data, and controlling to transmit either the generated information, or information corresponding to a predicted amount of ink to be used, the information being stored in storage means.

In a fourth aspect of the present invention, there is provided a program for making a computer for supplying image data perform a control method as mentioned above.

In a fifth aspect of the present invention, there is provided a storage medium storing a program for making a computer for supplying image data perform a control method as mentioned above.

According to the present invention, though the printing apparatus having the small and inexpensive constitution, the occurrence of fuzzy images during printing, due to the exhaust of ink in the sub-tank, can be prevented. Further, by performing the refilling of ink at an appropriate timing, a reduction in the printing throughput can be prevented. This is especially effective for the prevention of an unnecessary ink refilling operation when the amount of printed data is small, e.g., when characters are to be printed.

The above and other objects, effects, features and advantages of the present invention will become more apparent from the following description of embodiments thereof taken in conjunction with the accompanying drawings.

BRIEF DESCRIPTION OF THE DRAWINGS

FIG. 9 is an explanatory diagram showing predicted maximum values for ink amounts required to print an image on a predetermined type of printing medium having a predetermined size according to the second embodiment;

DETAILED DESCRIPTION OF THE PREFERRED EMBODIMENTS

The preferred embodiments of the present invention will now be described in detail while referring to the accompanying drawings.

Preferred embodiments of the present invention will be described with the accompanying drawing below. In the embodiments described below, as a printing apparatus using an ink jet printing system, a printer will be described as an example.

Incidentally, hereafter, the word "print" represents not only forming of significant information, such as characters, graphic image or the like but also represent to form image, patterns and the like on the printing medium irrespective whether it is significant or not and whether the formed image elicited to be visually perceptible or not, in broad sense, and further includes the case where the medium is processed.

The word "printing medium" represents not only paper to typically used in the printing apparatus but also cloth, plastic film, metal plate, glass, ceramics, wood and leather and the like and any substance which can accept the ink in broad sense.

The word "ink" should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

(Overview of the Main Body of an Ink Jet Printing Apparatus)

Figure 1:
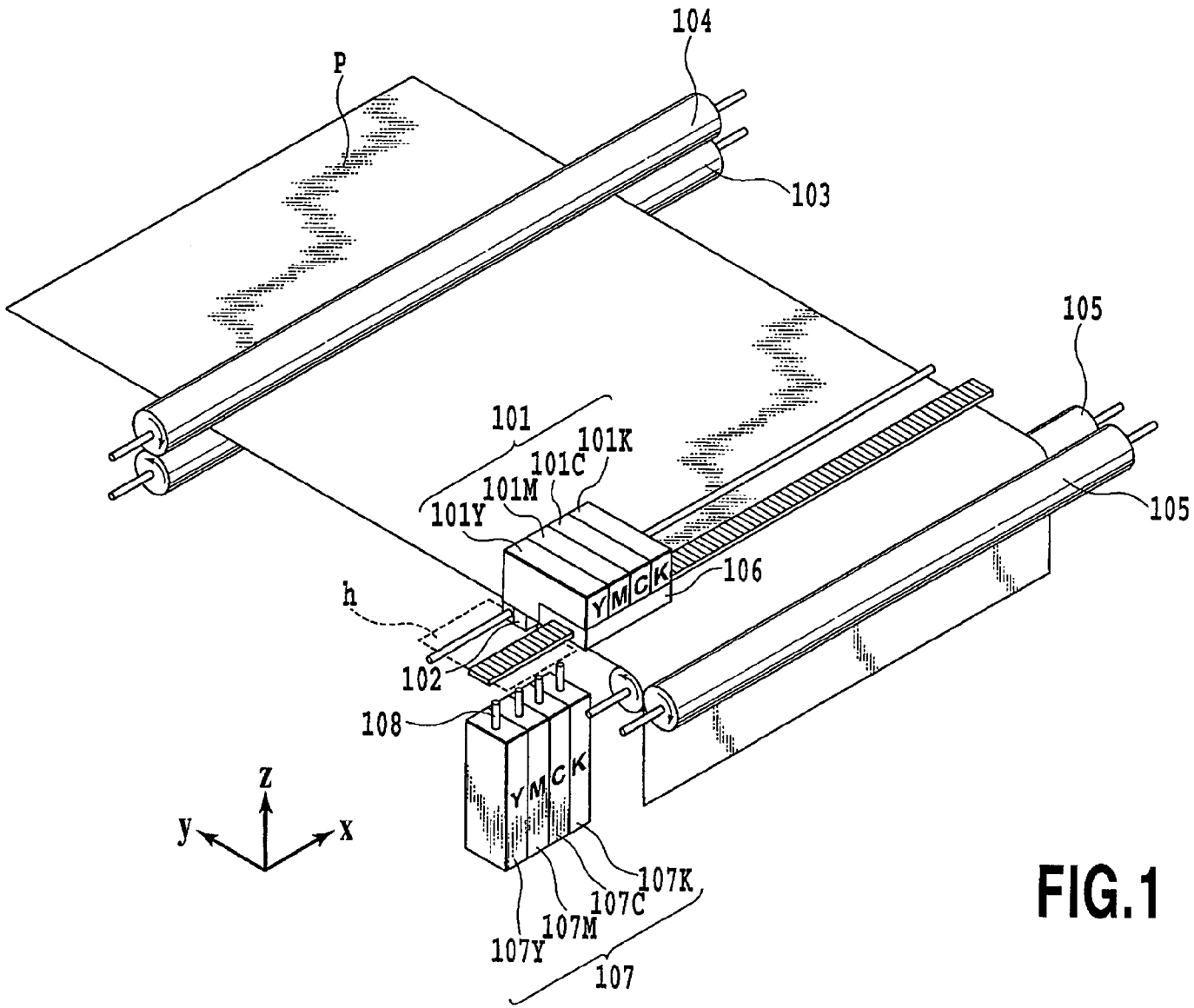
FIG. 1 is a schematic perspective view of an ink jet printing apparatus to which the present invention can be applied.

FIG. 1 is an exterior perspective view of an overview of a general configuration of an ink jet printing apparatus (hereinafter referred to simply as "a printing apparatus") applicable to the typical embodiments of the present invention.

As shown in FIG. 1, an ink cartridge is mounted on a carriage 106 that reciprocates in direction x (main scanning direction). The ink cartridge includes: sub-tanks 101K, 101C, 101M and 101Y, wherein predetermined amounts of four colors of ink, i.e., black (K), cyan (C), magenta (M) and yellow (Y) inks, may be respectively stored; and a printing head 102. The printing head 102 has ejecting portions for ejecting inks having individual colors. In the following explanation, when the sub-tanks 101K, 101C, 101M and 101Y are not specifically designated, the sub-tanks are collectively denoted by reference numeral 101.

Denoted 107K, 107C, 107M and 107Y are main tanks located at a fixed position within the apparatus, i.e., at the end of an area where the carriage 106 can move in the example in FIG. 1, and respectively contain K, C, M and Y inks. In the following explanation, when the main tanks 107K, 107C, 107M and 107Y are not specifically designated, the main tanks are collectively denoted by reference numeral 107. The carriage 106 is positioned opposite the main tanks 107 at an appropriate timing that will be described later. Then, the main tanks 107 are moved in direction z to connect ink supply needles 108, provided for the main tanks 107, to the sub-tanks 101, whereby the supply of ink is enabled.

When printing is being performed, a printing medium P is intermittently conveyed in the sub-scanning direction (direction y) perpendicular to the main scanning direction (direction x) of the carriage 106. The printing medium P is supported by a pair of rollers 105 and 105, located upstream (on the feed side) in the sub-scanning direction, and by a pair of rollers 103 and 104, located downstream (on the delivery side), and is conveyed while being applied with a constant tensile force. That is, the printing medium P is conveyed while relative to the ink ejection openings, provided for the ejecting portions of the printing head 12, its surface flatness is ensured. Then, printing to the printing medium is performed while alternately performing a printing operation for a length equivalent to the width of the ink ejection opening array provided for the ejecting portion of the printing head 102 and conveying of the printing medium P.

When printing is not being performed, or when a recovery process is to be performed for the printing head 102 or the sub-tanks 101 are to be resupplied (refilled) with ink from the main tanks 107, the carriage 106 is set in a position (a home position (h)) indicated by broken lines in FIG. 1. The recovery process is performed for the recovery to an appropriate ink ejection state of the printing head 102 or the maintenance of the appropriate ink ejection state. In order to perform this process, a unit can be employed, which includes: a cap used to close the ink ejecting portions; and a pump, which exerts a negative pressure within closed spaces defined by the cap, thus sucking ink in the ejection openings. Further, this unit can also be used for the ink refilling operation. That is, the suction of ink can be performed in a state where the main tanks 107 and the sub-tanks 101 are communicated with each other by ink supply needles 108. Thus, ink can be transferred from the main tanks 107 to the sub-tanks 101.

The recovery process can include an operation in which, at a predetermined timing, the face of the printing head where the ejection openings are formed is cleaned by a cleaning member (a cleaning blade) formed of a flexible material, such as rubber, and in which material attached to the face is removed. The recovery process can also include a preliminary ejecting operation in which, other than the ink ejecting operation for forming an image on a printing medium, a predetermined amount of ink is ejected in order to discharge ink having an increased viscosity.

Figure 2:
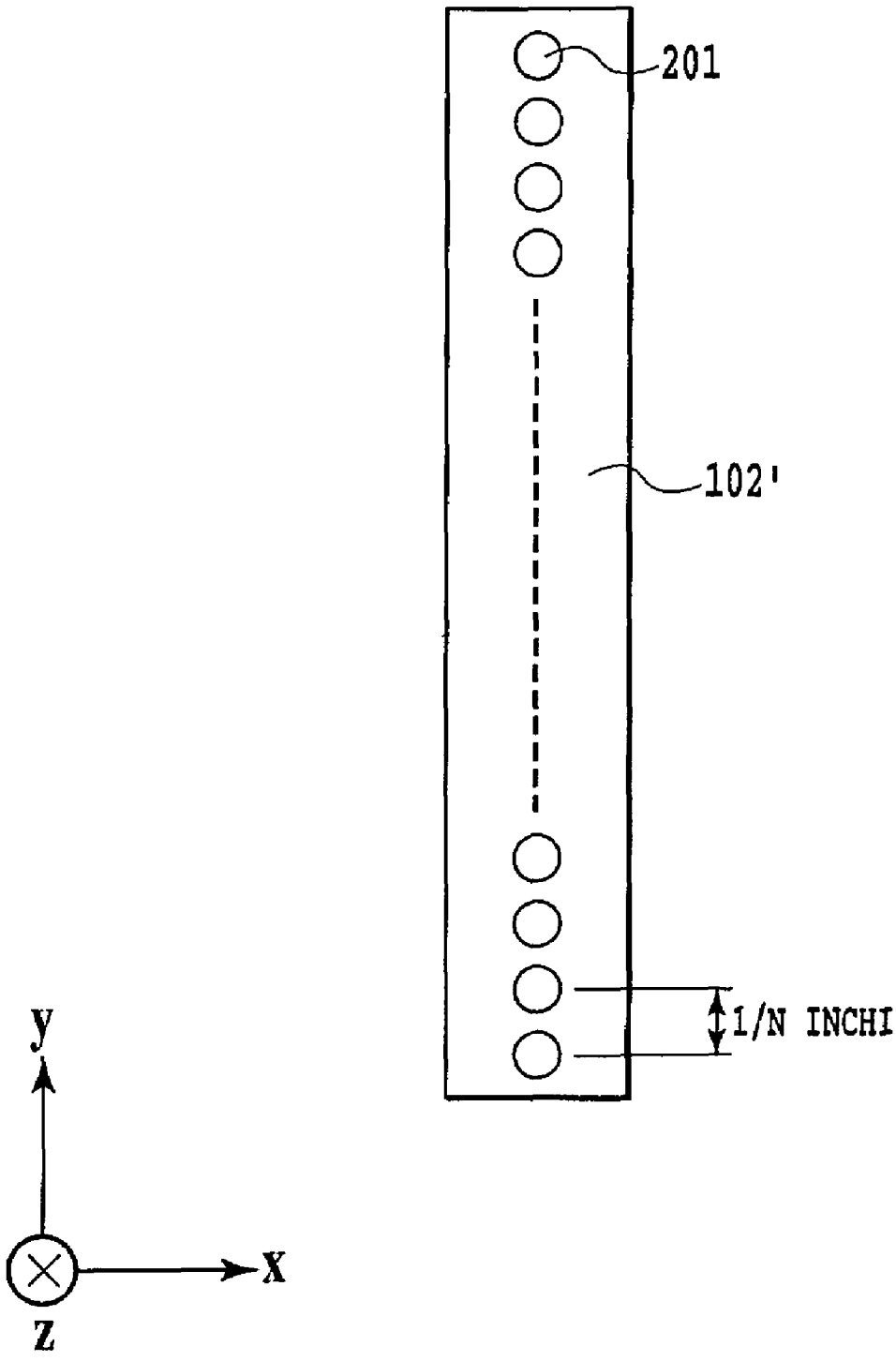
FIG. 2 is a diagram schematically showing ink ejection openings arranged at an ejecting portion for one color in an applicable printing head for the apparatus shown in FIG. 1.

FIG. 2 is a diagram showing ink ejection openings, as viewed in direction z, that are arranged in an ejecting portion 102' of the printing head 102 for a color. In FIG. 2, reference numeral 201 denotes ejection openings 201, which are arranged at pitches of 1/N inch in direction y. In this example, four colors of ink are employed, and a predetermined number of arrays corresponding to the individual colors are provided in parallel in direction x.

The printing operation performed by one main scanning of the carriage 106 will now be explained while referring to FIGS. 1 and 2. Assume that the carriage 106, before printing is started, is located at the home position h in FIG. 1. When the printing apparatus receives a printing start instruction from a computer, or another host apparatus, that serves as an image data supply source, the carriage 106 is moved from the home position h in direction x, and to perform the printing, in accordance with data received from the computer, by ejecting ink from the plurality of ejection openings 201, onto the printing medium P. When the printing performed during one main scanning has been completed, the carriage 106 is returned to the home position h, and while it is returning, the printing medium P is conveyed in direction y by a distance equivalent to the printing height (band) of one scanning by the printing head 102. Thereafter, the carriage 106 is again moved in direction x, and the printing for another scanning is performed. That is, as the carriage 106 performs the main scanning, an area having a length equivalent to the width of the ink ejection opening array provided for the printing head 102 is printed, and then, the printing medium P is conveyed. This process is repeated until the printing of data on the printing medium P has been completed.

Figure 3:
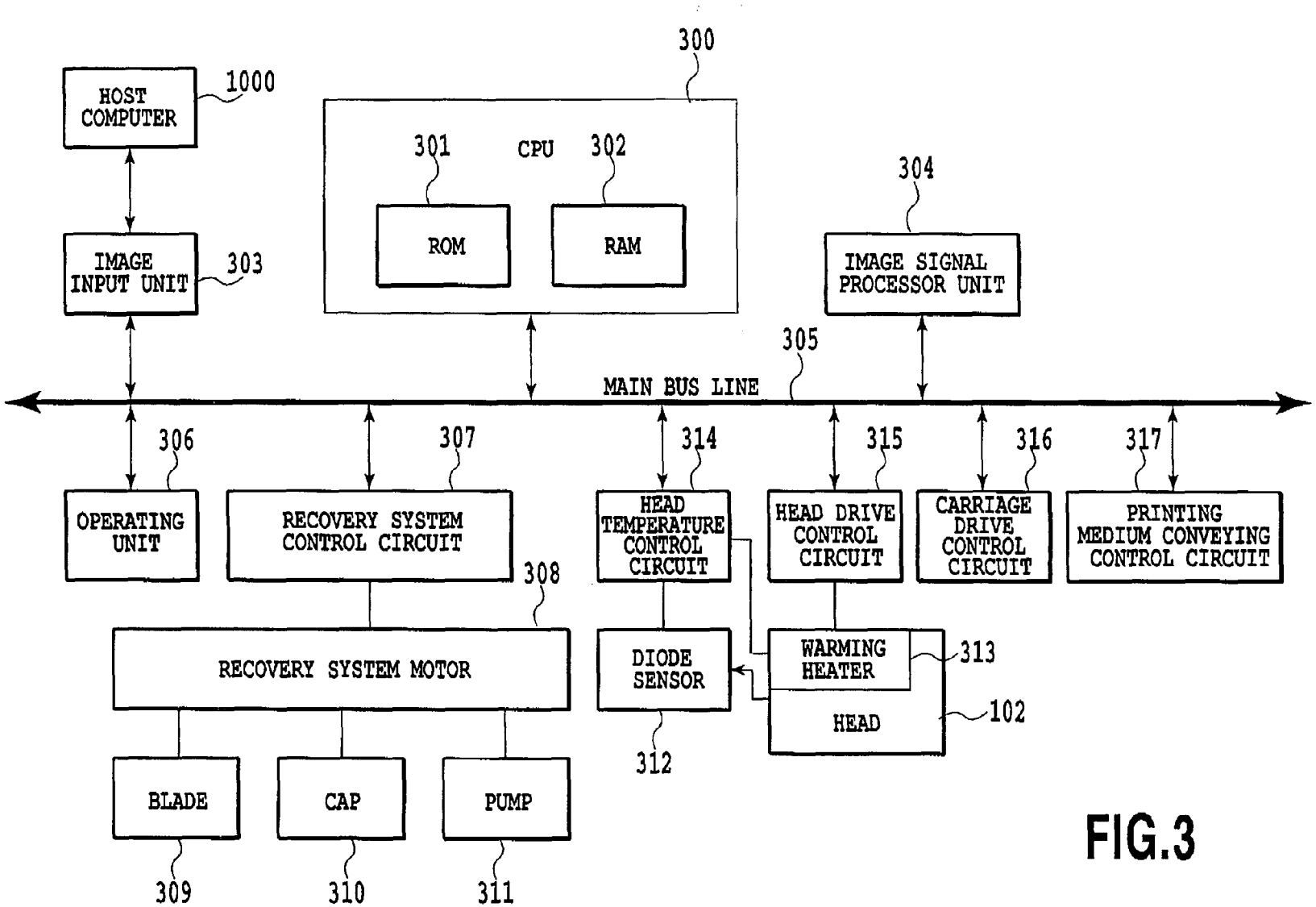
FIG. 3 is a block diagram showing an example configuration for the control system of the printing apparatus in FIG. 1.

FIG. 3 is a block diagram showing an example configuration for the control system of the printing apparatus shown in FIG. 1.

A control system of the printing apparatus is roughly categorized as being a data process sub-system and a mechanism control sub-system. As shown in FIG. 3, the data process sub-system includes: an image input portion 303, for accessing a main bus line 305; an image signal processor 304, for process an image signal input via the main bus line 305; and a CPU 300. The mechanism control sub-system includes: an operating portion 306, a recovery system control circuit 307, a head temperature control circuit 314, a head drive control circuit 315, a carriage drive control circuit 316 and a printing medium conveying circuit 317.

The image input portion 303 includes an interface, for receiving image data from a host apparatus (a host computer) 1000, which can be a constituent of an image forming system. The host computer 1000 can be a personal computer or a work station, and can include a known configuration constituted by a main body, input devices, such as a keyboard and a mouse, and a display device, such as a CRT. The main body of the host computer 1000 incorporates a CPU, a ROM, a RAM, a system bus, an I/O controller for various input/output devices, a transmitter/receiver for an external device, such as the printing apparatus, and an external storage device (a hard disk drive or a flexible disk drive). The host computer 1000 is operated based, for example, on an application program, a communication program, a printer driver and an operating system (OS). For the printing process, in accordance with the printer driver, the host computer 1000 transmits to the printing apparatus image data stored in the RAM or on the external storage device. Specifically, the host computer 1000 in this example stores a program that defines part of the process that will be described later while referring to FIG. 6, 11 or 13, and can execute this program.

The image input portion 303 may include an interface for receiving image data obtained from a digital camera, or an interface for receiving image data from an IC memory card (not shown).

The CPU 300 includes memories, such as a ROM 301 and a RAM 302. While an appropriate printing condition is applied for input information, the main scanning of the printing head 102 and the carriage 106 and the sub-scanning of the printing medium P are controlled through the head control circuit 315, the carriage drive control circuit 316 and the printing medium conveying circuit 317, and printing is performed. In addition to the program that defines part of the process that will be described later while referring to FIG. 6, 11 or 13, fixed data consonant with a predetermined table is stored in the ROM 301. The RAM 302 is used as a work area for the CPU 300. A program for performing the recovery process sequence is stored in the memory area. The CPU 300 supplies to the recovery system control circuit 307 and the head drive control circuit 315, as needed, a suction recovery operation condition, an operation condition for supplying ink from the main tanks 107 to the sub-tanks 101, a preliminary ejecting operation condition, and control data for defining timings for these operations. That is, the CPU 300 controls the mechanism control sub-system based on control data and image data transmitted by the host computer 1000 and based on various instruction signals entered from various switches provided for the operating portion 306. It should be noted that this control process is performed by a program stored in the ROM 301.

A recovery motor 308 drives a cleaning blade 309, a cap 310 and a pump 311. The head drive control circuit 315 executes driving of printing elements (e.g., electrothermal transducer elements for generating thermal energy that cause a film boiling of ink as energy to be used for ejecting ink) that are provided for the printing head 102. The operations performed by the printing head 102, in association with when the printing elements are driven, include ink ejection for printing and ink preliminary ejection.

A warming heater 313 is arranged on a board whereon the printing elements of the printing head 102 are provided. By electrifying the heater, the head temperature control circuit 314 can raise and adjust the temperature of the ink in the printing head 102 to a desired setup temperature. Further, a temperature sensor 312, such as a diode sensor, is also provided on the board and measures the actual temperature of ink in the printing head 102 to support the temperature adjustment performed by the head temperature control circuit 314. The diode sensor 312 may be located apart from the board, or may be located in the vicinity of the printing head 102.

Several embodiments applied for the above described system configuration will now be described.

First Embodiment

According to a first embodiment of the present invention, as shown in FIG. 2, one printing head is employed wherein one ink ejection opening array is provided for an ejecting portion for each color. In this embodiment, assume that black ink is to be ejected by a printing head 102. Further, each ejecting portion is composed of ejection openings the number (L) of which is 256 pieces arranged at a pitch of 1/600 inch (i.e., at a printing pixel density of 600 dpi (dots/inch)). Further, the ejecting portion is configured to be capable of ejecting one ink droplet of about 30 pl from each ejection opening as an ejecting amount. The ejecting portion is configured to eject the ink droplets with an ejection frequency of 15 KHz for stably ejecting them. Therefore, when ink droplets are to be ejected at 600 dpi in the main scanning direction, a carriage 106, on which the printing head 102 of the above described specification is mounted, is to be moved at about 25 inches/second in the main scanning direction.

Furthermore, for the first embodiment, assume that the maximum size of a printing medium is 4 inches wide×6 inches long.

Figure 4A:
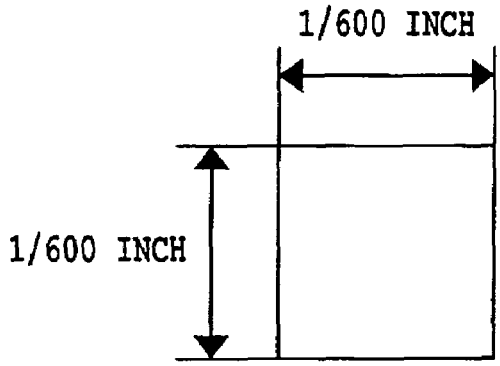
FIGS. 4A and 4B are diagrams showing image data for one pixel in a first embodiment of the present invention.
Figure 4B:
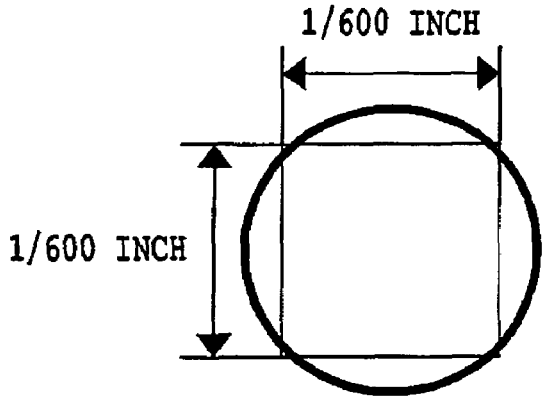

FIGS. 4A and 4B are diagrams showing image data for the printing of one pixel. In this example, the resolution is 600×600 dpi, and binary data for one bit corresponds to one pixel. That is, when the content of the data represent "0", as shown in FIG. 4A, no ink is ejected for that pixel, i.e., no dot is formed. When the data represent "1", as shown in FIG. 4B, an ink droplet of about 30 pl is ejected, and one dot is formed.

When so-called "solid" printing is to be performed across the entire area of the 4 inches×6 inches printing medium, the amount of the ink required is (600 dpi×4 inches)×(600 dpi×6 inches)×30 pl, which is approximately equal to 0.26 cc. It is assumed that the ink storage capacity of each sub-tank 101 is 0.4 cc (>0.26 cc), and the ink capacity of each main tank 107 is 8 cc.

The amount of ink remaining in the sub-tank 101 can be detected by subtracting the amount of the ink consumed from 0.4 cc, which is the amount of ink supplied from the main tank 107 and completely filled the sub-tank 101. The amount of ink consumed by printing or preliminary ejecting can be calculated by counting the number of ink droplets ejected by the printing head 102. The amount of ink consumed during the suction recovery operation can be calculated based on the volume of the pump, the period of time and the number of times at which it was driven.

Figure 5:
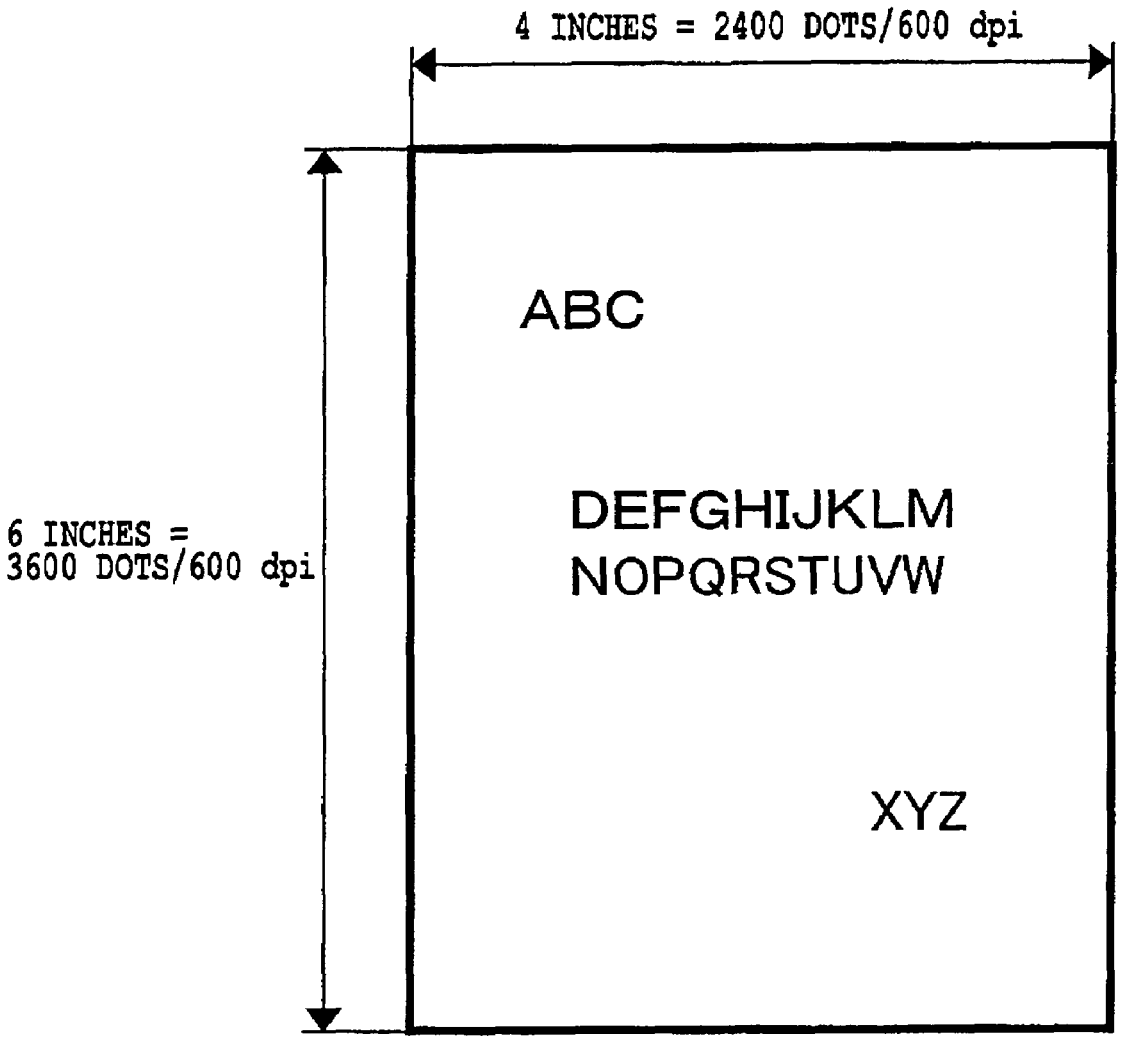
FIG. 5 is an explanatory diagram showing example image data to be printed on a printing medium having a predetermined size in the first embodiment.
Figure 6:
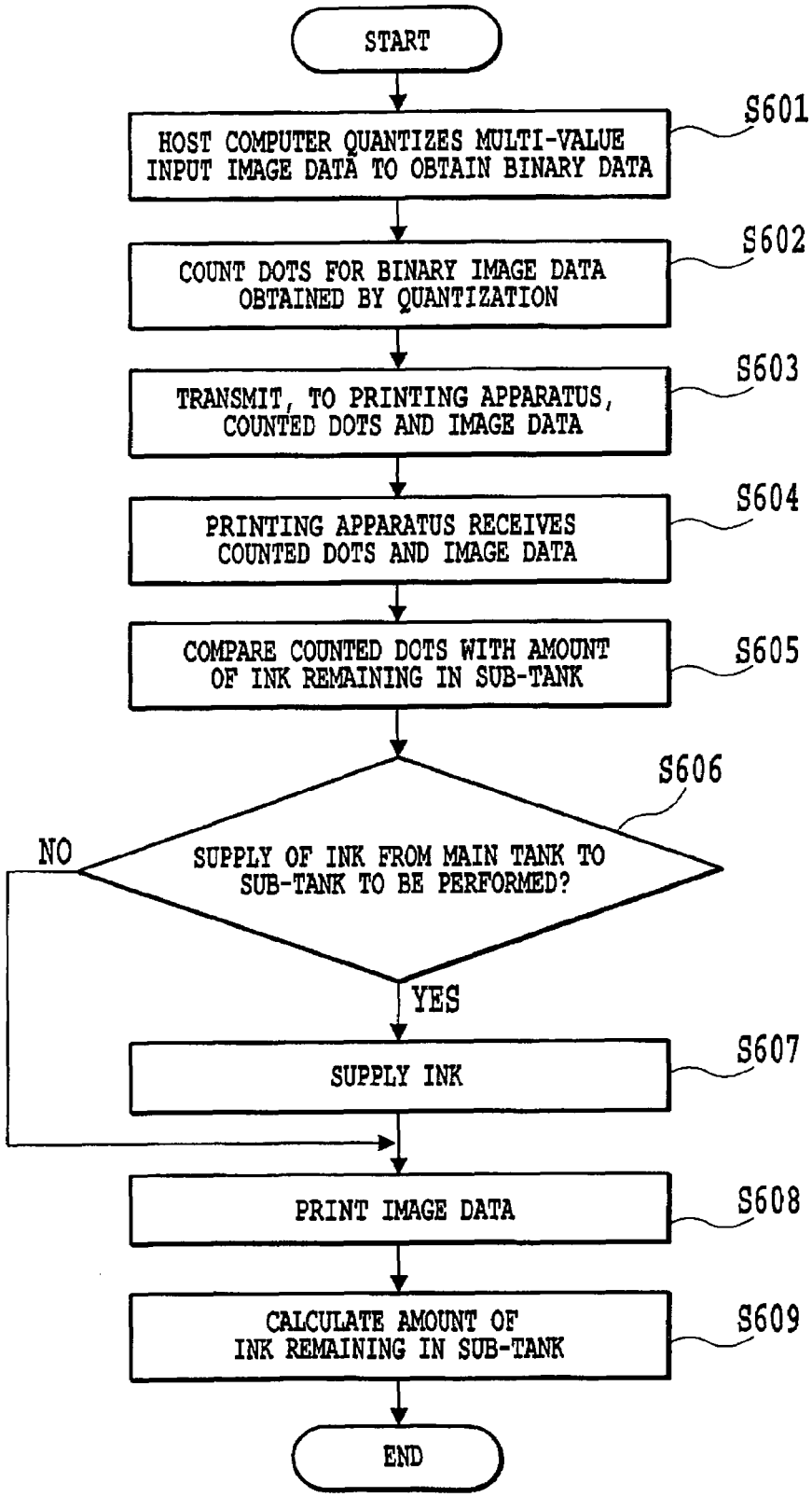
FIG. 6 is a flowchart showing printing control process performed in the first embodiment.

FIG. 5 is a diagram showing example image data to be printed on a 4 inches×6 inches printing medium, and FIG. 6 is a flowchart showing the printing process performed for the first embodiment. The process for the printing of the image data shown in FIG. 5 will now be described while referring to the flowchart in FIG. 6.

First, at step S601, a host computer 1000, which is an image data supply apparatus, performs quantization process for multi-value input image data with 8 bits for one pixel to obtain binary data of a resolution of 600×600 dpi. At step S602, all the dots to be printed are counted for the quantized binary image data in FIG. 5 of one bit for each pixel. In this case, assume that the number of dots is "15000". At step S603, information concerning the number of dots and the quantized image data are transmitted from the host computer 1000 to the printing apparatus. Up to this step, the process is performed by the host computer 1000.

At step S604, the printing apparatus receives information concerning the number of dots obtained by counting and the quantized image data. Then, at step S605, the received information for the number of dots is compared with the amount of ink currently remaining in the sub-tank 101. Assume that the amount of ink currently remaining in the sub-tank 101 is 0.2 cc. Further, since the number of dots, which has been received, is 15000, when this is converted into the amount of ink, $$15000\ \text{dots} \times 30pl = 0.00045cc$$

is obtained. On the other hand, a predetermined amount, e.g., 0.05 cc, is subtracted from the remaining ink amount of 0.2 cc, while taking into account a detection error for the amount of ink remaining and the amount of ink consumed by the recovery process performed before the start of printing and during the printing. The obtained value, 0.15 cc, is compared with 0.00045 cc, which is obtained by converting the number of received dots.

At step S606, a check is performed to determine whether "the remaining ink amount −0.05 cc"<"the ink amount required for printing" has been established. When the decision is affirmative, at step S607 the supply of ink from the main tanks 107 to the sub-tanks 101 (ink refilling) is performed, and thereafter, at step S608, the printing of image data is performed. On the other hand, when the decision is negative, ink refilling is not performed, at step S608 the printing of image data is performed. That is, since "0.2 cc−0.05 cc=0.15 cc<0.00045 cc" has not been established, the supply of ink from the main tanks 107 to the sub-tanks 101 is not performed, and at step S608 the printing of image data is performed.

When the printing of image data is finished, at step S609, the amount of ink remaining in the sub-tank 101 is calculated. In this case, the amount of ink used for printing and the amount of ink that will be consumed during the recovery process are subtracted from 0.2 cc which is the amount of ink remaining at the time before printing, and the obtained value, 0.1995 cc, is defined as the amount of ink remaining in the sub-tank. The amount of ink consumed in one printing is 0.0005 cc including the amount of ink that will be consumed during the recovery process. Therefore, if the printing of the image data in FIG. 5 is started when there is 0.2 cc of ink in the sub-tanks 101, printing can be performed 300 times (=0.15 cc/0.0005 cc). That is, until the image data in FIG. 5 will have been printed 300 times, ink from the main tanks 107 need not be supplied to the sub-tanks 101.

As described above, in this embodiment, a process for calculating the amount of ink required to print image data is not performed in the printing apparatus. Instead, the above described calculation process is performed by the host computer 1000 which includes: a CPU, which processes data at a much higher speed than a CPU 301 of a general printing apparatus; and a RAM, which has a memory capacity much larger than that of the general printing apparatus. That is, the host computer performs the process for counting the dots required for printing, as well as the image process in a printer driver. Therefore, while preventing increases in the manufacturing costs and in the size of the printing apparatus, the amount of ink required for printing can be rapidly calculated.

Figure 7:
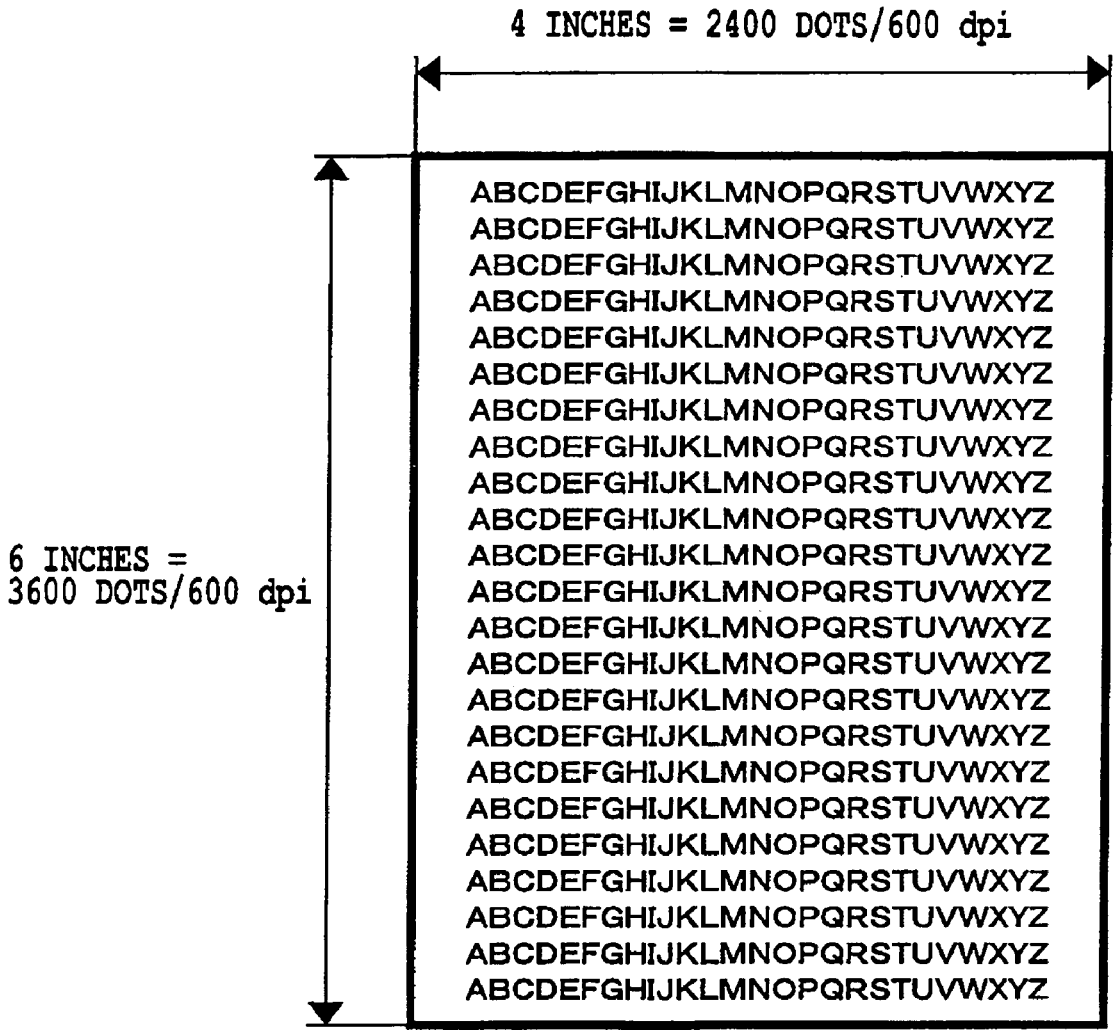
FIG. 7 is an explanatory diagram showing another example image data to be printed on a printing medium having the predetermined size in the first embodiment.

Assuming the case the printing is performed across the entire surface of a 4 inches×6 inches printing medium statically, the amount of ink required for printing would be predicted to be about 0.26 cc. When the amount of ink in the sub-tanks 101 is 0.2 cc, ink must be supplied from the main tanks 107 to the sub-tanks 101. Further, assuming the case of printing of image data shown in FIG. 7 (when the number of dots required for printing is predicted to be "135000", for example) instead of solid printing across the entire face, the amount of ink required would still be predicted to be 135000 dots×30 pl=0.00405 cc. Since the amount of ink consumed for one printing is 0.0455 cc including the ink consumed in the recovery process, only about 33 times, which is approximately equal to a value equivalent to 0.15 cc/0.00455 cc, of printing is possible for the image data shown in FIG. 5. That is, ink must be supplied from the main tanks 107 to the sub-tanks 101 every about 30 sheets of the printing media, and since the ink refilling process must be frequently performed, the printing throughput is reduced.

In contrast, according to the embodiment, the image data in FIG. 5 can be printed on about 300 sheets of printing media 4 continuously. As described above, in this embodiment, the amount of ink required for printing image data is actually calculated. Therefore, compared with the case when a fixed value obtained by prediction is employed, the frequency at which ink refilling processes are performed can be much reduced, and the occurrence of fuzzy images during printing, due to the exhaust of ink, can be prevented. Especially, in this embodiment, the performance of unnecessary ink refilling operations during the printing of characters can be effectively prevented.

In this embodiment, all printing has been performed using a 4 inches×6 inches printing medium. However, the printing medium size is not limited to the one used herein, and the similar effects can be provided for the printing media of other sizes.

Second Embodiment

In a second embodiment of the present invention, the similar apparatus and the similar system configuration as in the first embodiment are employed, and image forming is performed by ejecting black, cyan, magenta and yellow inks. Each of the ejecting portions for individual colors has the number (L=256) of ejection openings, and the interval between the ejection openings in a line is 1/600 inch, that is, the printing pixel density is 600 dpi. The black ink ejecting portion can eject ink droplets of about 30 pl each, and provided in one line of ejection openings. Each of the cyan, magenta and yellow ejecting portions can eject ink droplets of about 5 pl, and are provided in two lines of ejection openings arranged so that they can be shifted by ½ pitch in direction y. Therefore, the printing pixel density is achieved, twice as much as a printing pixel density in a line in the sub-scanning direction (direction y), that is 1200 dpi.

In this embodiment, assume that the ejection frequency for stably ejecting ink droplets is 15 KHz. Further, when ink droplets can also be ejected at a density of 1200 dpi in the main scanning direction for color printing by using cyan, magenta and yellow inks, the speed of the carriage in the main scanning direction is about 12.5 inches/second. In this embodiment, a printing medium of 4 inches×6 inches is also employed as the maximum size.

Figure 8A:
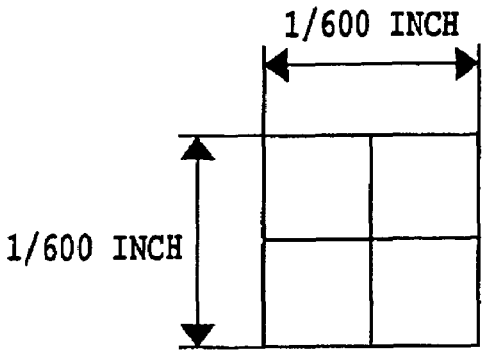
FIGS. 8A to 8D are diagrams showing image data for one pixel according to a second embodiment of the present invention.
Figure 8B:
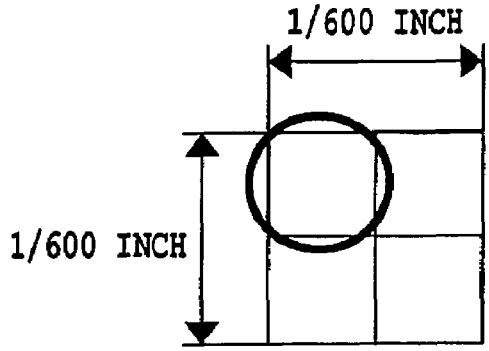
Figure 8C:
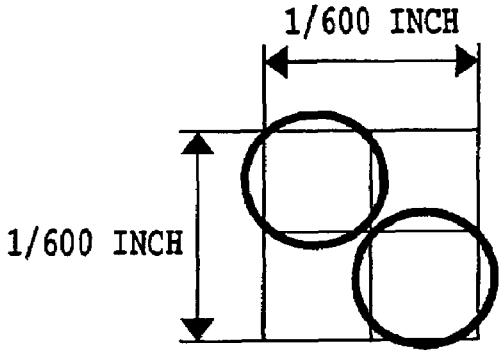
Figure 8D:
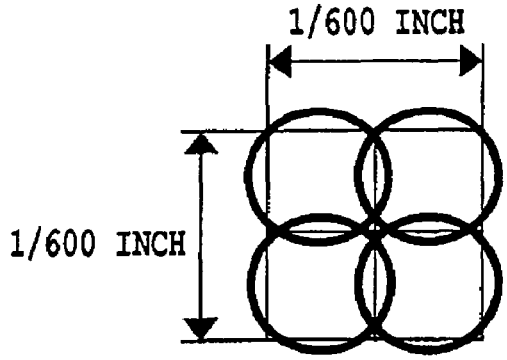

FIGS. 8A to 8D are diagrams showing image data for one pixel of ink in individual colors when color printing is performed on, for example, a sheet for photoprinting (a photoprinting medium) by employing only cyan, magenta and yellow ink. In this example, a printing pixel density for one pixel of image data at 600 dpi is 2×2 dots, and the amount of data is a four-level value of two bits. When the data value is "0", no dots are formed (FIG. 8A), and when the data value is "1", one dot is formed by the ejection of ink droplet of about 5 pl (FIG. 8B). When the data value is "2", two dots are formed by the ejection of ink droplets of about 5 pl (FIG. 8C), and when the data value is "3", four dots are formed by the ejection of ink droplets of about 5 pl (FIG. 8D). When characters are to be printed on a post card, instead of on a photoprinting medium, it is assumed that only black ink will be employed to form an image. In this case, the similar process is performed as in the first embodiment.

When color printing is performed for the entire area of a 4 inches×6 inches printing medium, the maximum required amount of each of cyan, magenta and yellow inks is 0.17 cc which is approximately equal to a value equivalent to (600 dpi×4 inches)×(600 dpi×6 inches)×5 pl×4 dots.

Assume that the ink retaining capacity of each of sub-tanks 101C, 101M and 101Y is 0.4 cc, which is larger than 0.17 cc, and the ink containing capacity of each of main tanks 107C, 107M and 107Y is 8 cc. Further, the maximum amount of black ink required to perform a printing on the entire area of a 4 inches×6 inches postcard is 0.26 cc, same to that in the first embodiment. The ink retaining capacity of sub-tank 101K is 0.4 cc, and the ink containing capacity of main tank 101K is 8 cc. The unit for detecting the amount of ink remaining in each sub tank 101 is the same as in the first embodiment.

FIG. 9 is a table indicating a predicted amount of ink required for printing a color image on a photoprinting medium of 4 inches×6 inches according to the embodiment. The table data may be stored in storage means of the host computer 1000. For cyan, magenta and yellow colors, the number of dots is set based on the assumption that printing will be performed across the entire 4 inches×6 inches area at a density of four dots per an area of 1/600 inch square. For black ink, 0 dot is set because in this embodiment such printing is not performed.

Figure 10:
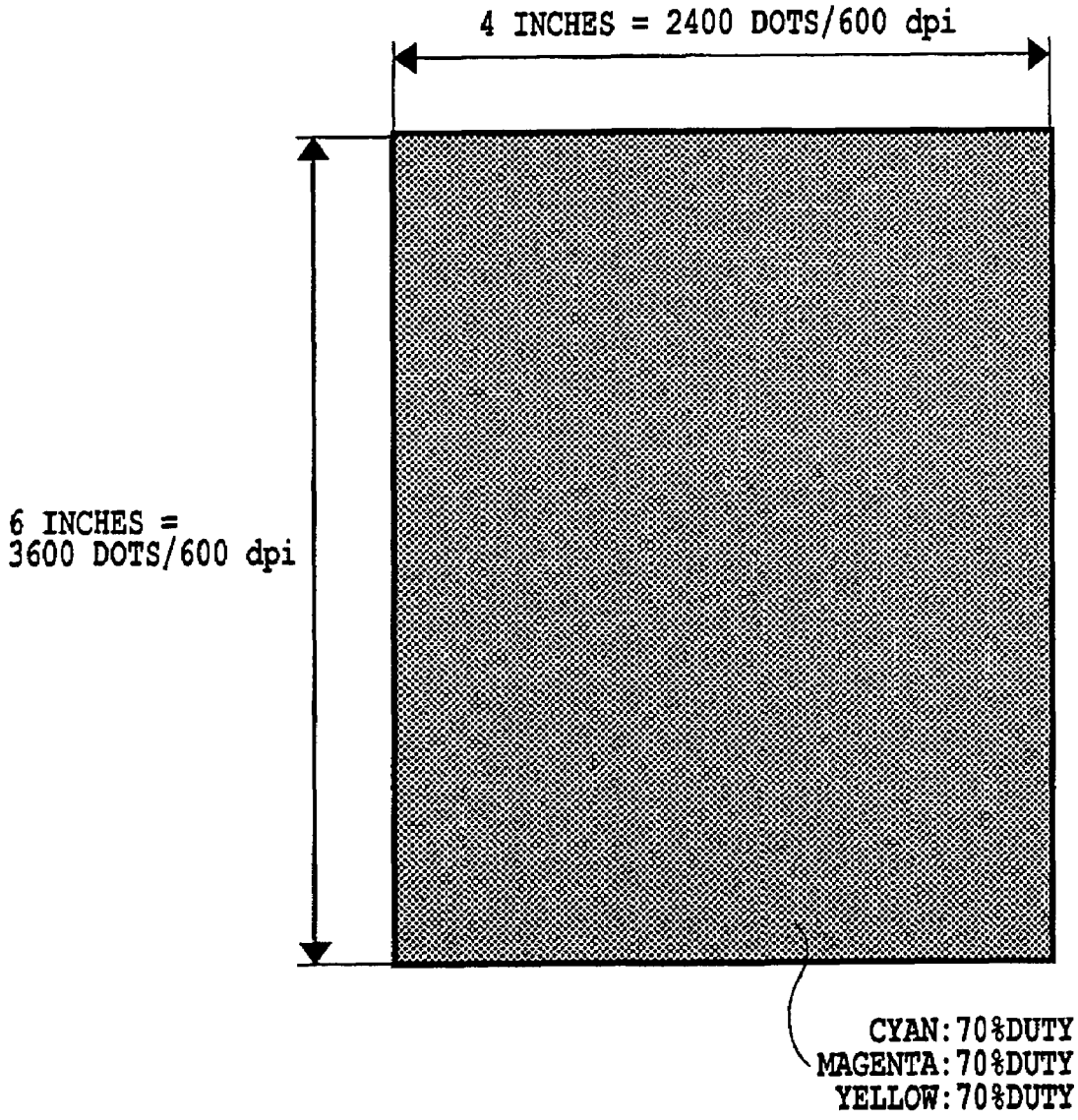
FIG. 10 is an explanatory diagram showing an example of image data to be printed on a predetermined type of printing medium having the predetermined size in the second embodiment.

FIG. 10 is a diagram showing image data in this embodiment, for which color printing is to be performed on a photoprinting medium of 4 inches×6 inches. In this case, assume that the image data are present in the entire 4 inches×6 inches area, and that, by ejecting ink droplets of about 5 pl, four dots are printed in each pixel at a density of 600×600 dpi in the entire 4 inches×6 inches area. This case is defined as a printing duty of 100%. FIG. 10 is a diagram showing image data when the printing duty of each of cyan, magenta and yellow color are 70%. Further, the image data to be printed on a 4 inches×6 inches postcard (not on a photoprinting medium) is the same as that in FIG. 5 which is used for the first embodiment.

Figure 11:
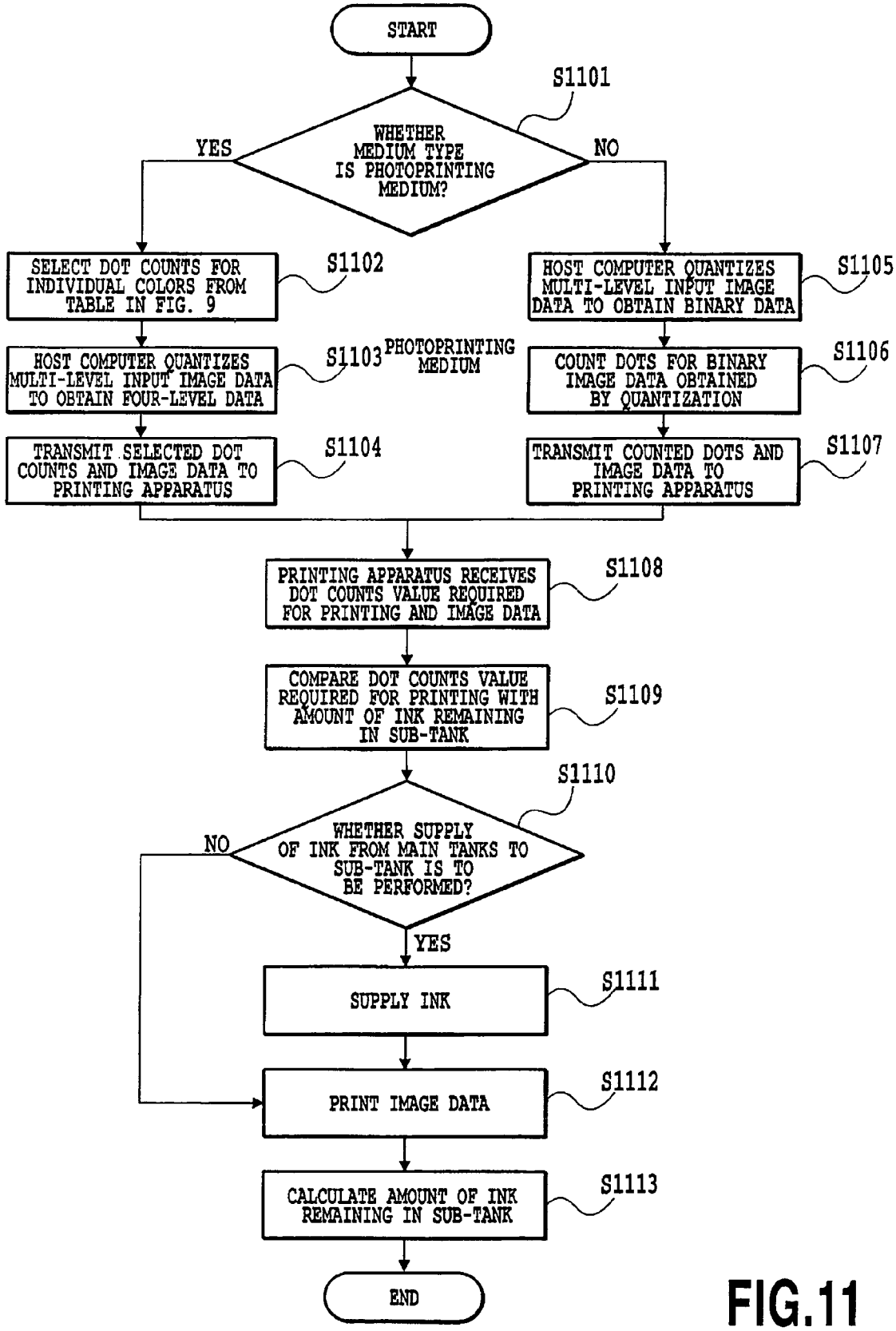
FIG. 11 is a flowchart showing printing control process performed in the second embodiment.

FIG. 11 is a flowchart showing the printing process performed in the second embodiment of the present invention.

First, at step S1101, the host computer 1000, which is an image data source apparatus, determines whether a color printing with cyan, magenta and yellow inks should be performed, alternatively a printing, for example, of characters with black ink should be performed. In this example, a check is performed to determine whether the selected printing medium is a photoprinting medium. When the decision is affirmative, at step S1102, the value of dot counts corresponding to the predicted maximum amount of the ink required for the printing with cyan, magenta, yellow and black is selected from FIG. 9. Then, at step S1103, the quantization process for four-level values is performed on input image data of multi-value having eight bits of each of cyan, magenta and yellow at a resolution of 600×600 dpi. At step S1104, the selected dot counts, and the image data on which the quantization process has been performed, are transmitted to the printing apparatus.

Following this, at step S1108, the printing apparatus receives the maximum dot counts required for printing, which are selected from the table in FIG. 9 (34560000 dots for each of cyan, magenta and yellow and 0 dot for black), and the image data on which the quantization process has been performed.

At step S1109, the received dot count 34560000 dots for each of cyan, magenta and yellow and 0 dot for black are compared with the amounts of ink currently remaining in the respective sub-tanks 101. At this time, the ink amount of the individual colors currently remaining in the sub-tanks is 0.2 cc. Further, the received dot count information "34560000" for the each of three colors is converted into the amount of ink 0.17 cc which is approximately equal to a value equivalent to 34560000 dots×5 pl. Further, as described above, considering the detection error for the ink remaining amount and the amount of ink consumed by the recovery process performed before or during the printing, 0.05 cc is subtracted from the remaining ink volume, "0.2 cc", and the obtained amount "0.15 cc" is compared with "0.17 cc".

At step S1110, whether "the ink remaining amount −0.05 cc"<"the amount of ink required for printing" is established, is determined. When the decision is affirmative, at step S1111, ink is supplied from the main tank 107 to the sub-tank 101, and at step S1112, the printing of image data is performed. That is, since "0.2 cc−0.05 cc=0.15 cc<0.17 cc" is established, the supplying of ink from the main tank 107 to the sub-tank 101 is performed. When through refilling the amount of ink in each sub-tank 101 reaches 0.4 cc, the sub-tanks 101 are completely filled. After that, at step S1112, while the printing apparatus receives image data transmitted from the host computer 1000, the printing is performed. When the decision at step S1110 is negative, the refilling with ink is not performed, and at step S1112, the printing of image data is performed.

After the printing of the image data has been completed, at step S1113, the amounts of the inks remaining in the sub-tanks 101 are calculated. When the amounts of cyan, magenta and yellow inks actually used for printing correspond to a printing duty of 70%, the ink remaining in the sub-tank for each colors is 0.12 cc which is approximately equal to a value equivalent to (600 dpi×4 inches)×(600 dpi×6 inches)×4 dots×5 pl×70%.

In addition, assume that the amount of ink consumed during the recovery process that is associated with one printing operation is 0.00005 cc. Furthermore, 0.12 cc, which is the amount of ink used for printing, and 0.00005 cc, which is the amount of ink used during the recovery process associated with one printing, are subtracted from 0.4 cc, which is the amount of each of the cyan, magenta and yellow inks remaining at the time before printing. The obtained ink volume 0.27995 cc is defined as the amount of ink remaining in each of the sub-tanks 101C, 101M and 101Y. As for black ink, since there is no image data to be printed, 0.00005 cc, which is the amount of ink consumed during the recovery process, is subtracted from 0.2 cc, which is the amount of ink remaining at the time before printing, and the obtained volume 0.19995 cc is defined as the amount of ink remaining in the sub-tank 101K.

On the other hand, when it is determined at step S1101 that the printing medium type is not a photoprinting medium, at steps S1005 to S1107, the processes which are similar to the steps S601 to S603 in the first embodiment, are performed. Furthermore, the processes at steps S1108 to S1113 which are performed by the printing apparatus after receiving quantized black image data, and which are also similar to the steps S604 to S609 in FIG. 6.

Recording media other than photoprinting media is often employed for printing characters. In this case, the amount of data for one pixel is small and only one color, black is employed. Further, the probability that image data are present in the entire area of a printing medium is very low. In this embodiment, as in the first embodiment, a process for calculating the amount of ink required to print image data is not performed in the printing apparatus. Instead, the above described calculation process is performed by the host computer 1000 which includes: a CPU, which processes data at a much higher speed than a CPU 301 of a general printing apparatus; and a RAM, which has a memory capacity much larger than that of the general printing apparatus. That is, the host computer performs the process for counting the dots required for printing, as well as the image process in a printer driver. Therefore, while preventing increases in the manufacturing costs and in the size of the printing apparatus, the amount of ink required for printing can be rapidly calculated.

In contrast, photoprinting media are often employed for printing natural pictures. Since the printing of images at a higher quality than the printing of characters is desired, a large amount of data is provided for one pixel and many colors are employed. In addition, the probability that image data are present in the entire area of a printing medium is considerably higher than that of the case when characters are printed. Therefore, while predicting the maximum amount of ink required for the printing as the number of dots that have been designated in advance, the data indicating the required ink amount for the printing can be transmitted to the printing apparatus without waiting for the completion of quantization process for image data of the entire area. As described above, for the printing of a natural picture on a photoprinting medium, increases in the cost and the size of printing apparatuses can be prevented, and the amount of ink required for printing can be rapidly calculated.

As described above, in the second embodiment, whether the amount of ink required for printing image data should actually be calculated or whether a fixed value obtained by prediction should be employed is determined in accordance with the type of printing medium. Therefore, data of the ink amount required for printing can be rapidly and efficiently generated in accordance with the type of a printing medium. Accordingly, while preventing the occurrence of fuzzy images which are caused when the ink is exhausted during printing, and the frequency of the ink supply from the main tank 107 to the sub-tanks 101 can be reduced.

In this embodiment, printing has been performed for a 4 inches×6 inches printing medium. However, the printing medium size is not limited to the one used herein, and the similar effects can be provided for the printing media of other sizes. Further, in the table in FIG. 9, which is used for the value of dot counts based on a predicted amount of ink required for printing, the value maybe set according to the individual printing media sizes, such as A4-size (210 mm×294 mm) and the like. Or, a fixed value obtained by prediction along the size of an image to be printed, may be set or calculated. Furthermore, in this embodiment, when a printing medium other than a photoprinting medium is employed, the ink color for which the ink amount required for the printing is calculated, is one color, black. However, this calculation process can also be employed for monochrome printing that uses another color, or can be employed when multiple colors, such as cyan, magenta and yellow, are used in the case when a small amount of data is required for each pixel.

Third Embodiment

In the second embodiment, whether the amount of ink required for printing image data should actually be calculated, alternatively a fixed value obtained by prediction should be employed is determined in accordance with the type of a printing medium. According to a third embodiment of the present invention, a required process is performed in accordance with the determination of an image printing mode, that is, which of high-quality image printing and high-speed printing is desired. In this embodiment, the similar configuration as in the second embodiment is employed for a printing apparatus and a printing head. Further, as in the first and the second embodiment, the description will be provided of the case where the maximum size of a printing medium is 4 inches×6 inches.

Figure 12A:
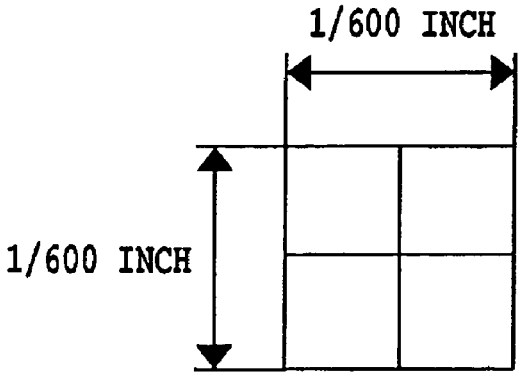
FIGS. 12A and 12B are diagrams showing image data for one pixel according to a third embodiment of the present invention.
Figure 12B:
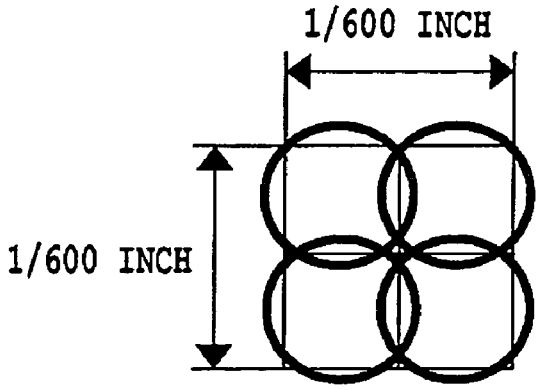

FIGS. 12A and 12B are diagrams showing image data for one pixel of an individual ink color when a photoprinting medium is selected as a printing medium, and when image printing is performed using cyan, magenta and yellow inks in a high-speed printing mode. In this case, the printing pixel density for one pixel (1/600 inch square) of 600 dpi image data is 2×2 dots, and the amount of data is provided with binary of one bit. When the data is "0", no dot is printed (FIG. 12A), but when the data is "1", four dots are printed by ejecting ink droplets of about 5 pl (FIG. 12B).

On the other hand, when a photoprinting medium is selected as a printing medium and high-quality image printing is performed using cyan, magenta and yellow inks image data for one pixel is the same to that shown in FIGS. 8A to 8D of the second embodiment.

Further, as in the second embodiment, for carrying out color printing over an entire area of a printing medium of 4 inches×6 inches, the required maximum amount of each of cyan, magenta and yellow inks is about 0.17 cc, the capacity of the sub-tank 101 is 0.4 cc which is greater than the required maximum ink amount, and the capacity of the main tank 107 is 8 cc. The unit used for detecting the amount of the ink remaining in the individual sub-tanks 101 is the same as those used in the first embodiment.

Furthermore, the table (FIG. 9) used in the second embodiment is also employed for predicting the amount of ink required for printing a high-quality image on a photo-printing medium of 4 inches×6 inches. Moreover, the image data (FIG. 10) used in the second embodiment is also employed for explaining.

Figure 13:
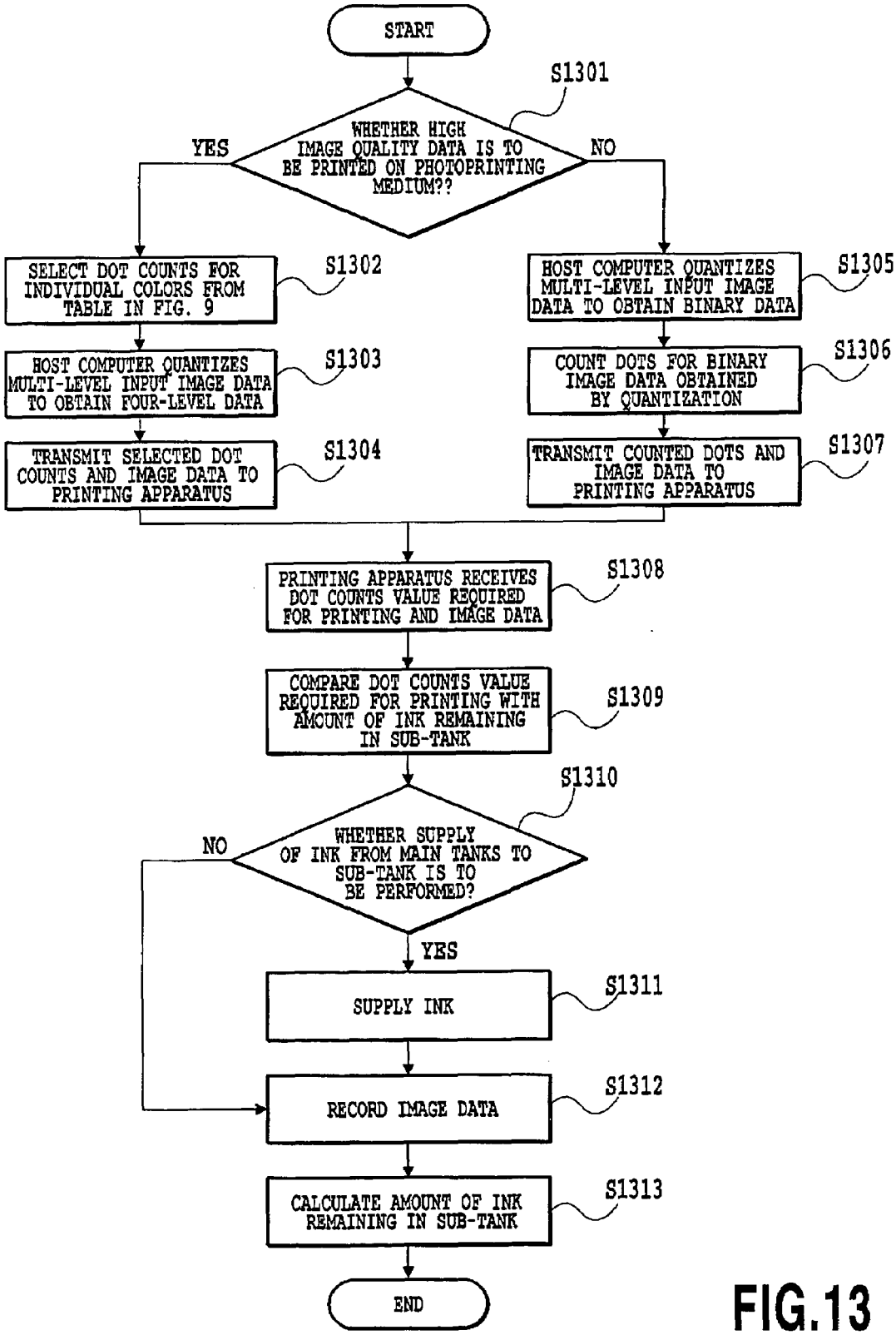
FIG. 13 is a flowchart showing printing control process performed in the third embodiment.

FIG. 13 is a flowchart indicating the printing process performed for the third embodiment.

First, at step S1301, the host computer 1000, which is an image data source apparatus, determines whether the high-quality image printing mode is employed when the dada is printed on a photoprinting medium. When the decision is affirmative, the procedure proceeds to step S1302, and thereafter, the host computer 100 performs the processes at steps S1302 to S1304 which are similar to the steps S1102 to S1104 in FIG. 11 of the second embodiment. Further, the printing apparatus performs steps S1308 to S1313 which are similar to the steps S1108 to S1113 in FIG. 11.

When the decision at step S1301 is negative, the procedure proceeds to step S1305, and thereafter, the host computer 100 performs the processes at steps S1305 to S1307, which are basically similar to the steps S1105 to S1107 in FIG. 11 of the second embodiment. Furthermore, the printing apparatus performs steps S1308 to S1313 which are similar to the steps S1108 to S1113 in FIG. 11. This example is related to the process performed for the high-speed printing of a color image, and the description thereof will be given below.

At step S1305, the quantization process used to obtain binary data, as shown in FIG. 2, is performed for input image data of multi-value (e.g., the image data shown in FIG. 10) where 8 bits of each cyan, magenta and yellow, are employed for each pixel at a resolution of 600×600 dpi. Then, at step S1306, all the dots to be printed are counted for the image data obtained, in FIG. 10, by quantization. In this case, assume that the counted dot number of each of cyan, magenta and yellow dots is "24192000". The dot for black is then 0 because there are no image data. At step S1307, information about the counted dot number of each of cyan, magenta and yellow which is 24192000 dots, information about the dot number of black which is 0, and the quantized image data are transmitted to the printing apparatus.

In accordance with these received data (step S1308), at step S1309, the printing apparatus compares the cyan, magenta and yellow dot count "24192000" with the amounts of the inks currently remaining in the individual sub-tanks 101. At this time, assume that the amount of ink remaining in each sub-tank is 0.2 cc. Meanwhile, the received dot number information "24192000" is converted into the ink amount of 0.12 cc which is approximately equal to a value equivalent to 24192000 dots×5 pl. Then, in the same manner as described above, considering detection errors for the remaining ink volumes and the amount of ink consumed by a recovery process before or during printing, 0.05 cc is subtracted from the remaining ink volume 0.2 cc, and the obtained volume 0.15 cc is compared with 0.12 cc.

At step S1310, whether the "remaining ink volume −0.05 cc"<"the amount of ink required for printing" is established, is determined. When the decision is affirmative, at step S1311, ink from the main tank 107 is supplied to the sub-tank 101 (ink refilling). Thereafter, at step S1312, the printing of image data is performed. When the decision at step S1310 is negative, the ink refilling is not performed and the procedure proceeds to step S1312, then the printing of image data is performed. That is, since "0.2 cc−0.05 cc=0.15 cc<0.12 cc" is not established, the supplying of ink from the main tank 107 to the sub-tank 101 is not performed, and at step S1312, the printing of image data is performed.

When the printing of image data is finished, at step S1313, the amounts of the inks remaining in the sub-tanks 101 are calculated. That is, the amount of the ink consumed for printing, 0.12 cc, and the amount of the inks consumed during the recovery process, 0.00005 cc, are subtracted from each of the amounts of the remaining cyan, magenta and yellow inks at the time before printing, 0.2 cc. The obtained amount 0.07995 cc is defined as the ink remaining amount in each of the sub-tanks 101C, 101M and 101Y. As for black ink, since there is no image data are to be printed, the amount of ink consumed during the recovery process, 0.00005 cc, is subtracted from the amount of ink remaining at the time before printing, 0.2 cc. The obtained volume 0.19995 cc is defined as the amount of ink remaining in the sub-tank 101K.

As described above, when a high-speed printing mode in which high quality is not requested is designated for the printing of a color image such as a natural picture on a photoprinting medium, the amount of data for each pixel is small, even though there is a high probability that image data are present in the entire area of the printing medium. In this embodiment, as in the first embodiment, a process for calculating the amount of ink required to print image data is not performed in the printing apparatus. Instead, the above described calculation process is performed by the host computer 1000 which includes: a CPU, which processes data at a much higher speed than a CPU 301 of a general printing apparatus; and a RAM, which has a memory capacity much larger than that of the general printing apparatus. That is, the host computer performs the process for counting the dots required for printing, as well as the image process in a printer driver. Therefore, while preventing increases in the manufacturing costs and in the size of the printing apparatus, the amount of ink required for printing can be rapidly calculated.

In contrast, in a mode for high quality printing of a natural picture on a photoprinting medium, the amount of data for one pixel is large, and many colors are required. In addition, the probability that image data is present in the entire area of a printing medium is considerably higher than when characters are printed. Therefore, while predicting the maximum amount of ink required for the printing as the number of dots that has been designated in advance, the data indicating the required ink amount for the printing can be transmitted to the printing apparatus, without waiting for the completion of the quantization process for the image data of the entire area of the printing medium. As described above, for the printing of a natural picture to be printed on a photoprinting medium, an increase in the cost and in the size of the printing apparatus can be prevented, and the amount of ink required for printing can be rapidly calculated.

As described above, in the third embodiment, whether the amount of ink required for printing image data should actually be calculated, alternatively a fixed value obtained from prediction should be employed is determined in accordance with the printing mode, that is, whether a high image quality is requested. Accordingly, even when the image quality differs and therefore the amount of data for one pixel differs, data for the amount of ink required for the printing can be generated rapidly and efficiently. Thus, while preventing the occurrence of a fuzzy image which is caused when the ink exhausted during the printing, the frequency of the ink supply from the main tanks 107 to the sub-tanks 101 can be reduced.

In this embodiment, printing has also been performed for a 4 inches×6 inches printing medium. However, the printing medium size is not limited to the one used herein, and the same effects can be provided for the printing medium of other sizes. Furthermore, as in the second embodiment, a fixed value obtained by prediction may be designated or one may be calculated in accordance with the size of each printing medium, or the size of each image to be printed.

(Others)

In the above described embodiments, the host computer, which is an image data source apparatus, has transmitted, to the printing apparatus, a count value or a predicted value for the dots required for the printing. This value, however, may be converted into an ink volume, and the ink volume may be transmitted to the printing apparatus.

Further, as an image information parameter for the generation or the printing of image data, information for a printing medium type is employed in the second embodiment, moreover information for a printing mode (high-quality printing or high-speed printing) is employed in the third embodiment. In these embodiments, based on this information, it is determined whether the amount of ink required for printing image data should actually be calculated, alternatively a predicted fixed value should be employed. It is obvious, however, parameters such as the printing medium type, the printing quality, the size of a printing medium, the size of an image to be printed, and the amount of data for one pixel may be individually employed, or may be employed in combination.

For the ink jet printing apparatus applied for the above described system, various ink ejection methods are available. Therefore, either the above described electrothermal transducer element for generating thermal energy that induces film boiling in ink in accordance with the electrification provided, or an electro-mechanical energy converting element such as a piezoelectric element, may be employed.

Furthermore, the present invention is appropriate for applying to an ink jet printing apparatus that employs an on-demand ink supply system, and an image forming system that employs this ink jet printing apparatus. Description has been given so far of a system where an ink supply path between a main tank and a sub-tank is to be capable of separating spatially. However, another on-demand supply system may be employed where the first and second ink tanks, instead of being separated, are hydraulically isolated by using valves, for example, to disconnect the ink supply path.

In addition, four ink colors, cyan, magenta, yellow and black, have been employed in the embodiments. However, the number of tones such as colors and density, and a type of the ink to be employed, can be arbitrarily designated. Further, for a configuration employing inks with multiple tones, refilling of the sub-tanks may be performed simultaneously or may be performed individually.

Moreover, the above numerical values are merely examples, and the present invention is not limited to these values.

A host apparatus that supplies printing-associated data to the printing apparatus can be not only a computer, but can also be a digital camera or an image scanner. The computer may be an office computer or a work station in addition to a personal computer, moreover, it may be a PDA such as an electronic notebook or a hand held computer. Further, an image forming system may be designed so that a printing apparatus and an image data source apparatus are either separable or integrally formed not to be separable, or it may be designed so that a printer and an image data source apparatus which are constructed separately, are connected with each other.

Still further, the scope of the present invention embraces a printing system to which a program code of a software or printer driver which realizes the functions associated with the computer is supplied, thereby realizing the various functions stated above according to the program codes stored in the computer.

In the above structure, the program code itself achieves a new function of the present invention. The program code itself, and means for supplying such program code to the computer via communication or storage media all are encompassed within the scope of the present invention.

As the storage medium for supplying the program code, any of the following media can be utilized: for example, flexible disks, DC-ROMs and others such as hard disks, optical disks, optical magnetic disks, CD-Rs, DVDs, magnetic tapes, nonvolatile memory cards and ROMs.

Also, the present invention includes not only the case that execution of the program code read out by the computer achieves the functions of the embodiment stated above, but also includes the case that, based on the instruction of the program code, OS and the like being activated on the computer performs a part or all of the actual processes, thereby realizing the functions of the above embodiments.

Furthermore, the scope of the present invention also encompasses the case that the program code read out from the storage medium is written in a memory stored in a function expanding board inserted into the computer or a function expanding unit connected to the computer, and then, based on the instruction of the program code, CPU or the like incorporated into the function expanding board or the function expanding unit performs a part or all of the actual processes, thereby achieving the function of the above embodiments.

Additionally, a configuration of the image forming system may includes, regardless of personal use, business use or industrial use, an image data supplying device such as computer, scanner and digital camera and a printer as an image output terminal, in addition to, for example, an apparatus having a scanner and a printing apparatus all in one, a facsimile machine having a data transfer device and a printer all in one, a word processor or electric typewriter each having a printer, and a digital camera having a printer in one.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2005-112470 filed Apr. 8, 2005, which is hereby incorporated by reference herein.

What is claimed is:

1. An image forming system comprising:

an image data supply apparatus for supplying image data; and a printing apparatus for, based on the received image data, employing an ink jet printing head to perform printing, wherein the image data supply apparatus includes:

generating means for generating amount information that corresponds to an amount of ink to be used for printing an image data as an image on a printing medium based on the image data;

storage means for storing amount information corresponding to a predicted amount of ink to be used;

analysis means for analyzing an image information parameter of the image data; and transmitting means for transmitting amount information, as well as the image data, to the printing apparatus, wherein said transmitting means transmits the amount information generated by said generating means or the amount information stored in said storage means based on the analysis of the image information parameter, and wherein the printing apparatus includes:

a main tank, which serves as a source for supplying ink to the ink jet printing head;

a sub-tank for receiving ink from the main tank, and for supplying the ink to the ink jet printing head;

supplying means for supplying ink from the main tank to the sub-tank;

detecting means for detecting the amount of ink in the sub-tank;

receiving means for receiving the amount information and the image data; and determining means for, prior to printing the image data, based on the received amount information and the amount of ink in the sub-tank as detected by the detecting means, determining whether the supply of ink by the supplying means should be performed.

2. An image forming system as claimed in claim 1, wherein the image information parameter is at least one of a printing medium type, a printing medium size, a printing image size, a printing quality and an amount of data for one pixel.

3. A print control method for an image forming system comprising:

an image data supply apparatus for supplying image data; and a printing apparatus for, based on the received image data, employing an ink jet printing head to perform printing, wherein the printing apparatus includes:

a main tank, which serves as a source for supplying ink to the ink jet printing head, a sub-tank for receiving ink from the main tank, and for supplying the ink to the ink jet printing head, detecting means for detecting the amount of ink in the sub-tank, and supplying means for supplying ink from the main tank to the sub-tank;

the method comprising the steps of:

generating amount information that corresponds to an amount of ink to be used for printing the image data as an image on a printing medium based on the image data;

storing amount information corresponding to a predicted amount of ink to be used;

analyzing an image information parameter of the image data;

transmitting amount information, as well as the image data, to the printing apparatus from the image data supply apparatus;

detecting the amount of ink in the sub-tank at the printing apparatus;

receiving the amount information and the image data at the printing apparatus; and prior to printing the image data, based on the received amount information and the amount of ink in the sub-tank as detected by the detecting step, determining whether the supply of ink by the supplying means should be performed, at the printing apparatus, wherein in said step of transmitting, the generated amount information or the stored amount information is transmitted, based on the analysis of the image information parameter in said step of analyzing.

4. A print control method as claimed in claim 3, wherein the image information parameter is at least one of a printing medium type, a printing medium size, a printing image size, a printing quality and an amount of data for one pixel.

5. A print control method for a printing apparatus, wherein based on supplied image data, the printing apparatus employs an ink jet printing head to perform printing, and wherein the printing apparatus includes a main tank, which serves as a source for supplying ink to the ink jet printing head, a sub-tank for receiving ink from the main tank, and for supplying the ink to the ink jet printing head, detecting means for detecting the amount of ink in the sub-tank, and supplying means for supplying ink from the main tank to the sub-tank;

the method comprising the steps of:

generating amount information that corresponds to an amount of ink to be used for printing the image data as an image on a printing medium based on the image data;

storing amount information corresponding to a predicted amount of ink to be used;

analyzing an image information parameter of the image data;

transmitting amount information, as well as the image data, to the printing apparatus;

wherein in said step of transmitting, the generated amount information or the stored amount information is transmitted, based on the analysis of the image information parameter in said step of analyzing, and wherein, prior to printing the image data, and based on the received amount information and the amount of ink in the sub-tank detected by the detecting means, the printing apparatus determines whether the supply of ink by the supplying means should be performed.

6. A print control method as claimed in claim 5, wherein the image information parameter is at least one of a printing medium type, a printing medium size, a printing image size, a printing quality and an amount of data for one pixel.

7. A computer-executable program stored on a computer-readable storage medium, for making a computer which supplies image data perform a control method as claimed in claim 5.

8. A computer-readable storage medium storing a computer-executable program for making a computer which supplies image data perform a control method as claimed in claim 5.

* * * * *

UNITED STATES PATENT AND TRADEMARK OFFICE

CERTIFICATE OF CORRECTION

PATENT NO. : 7,380,900 B2
APPLICATION NO. : 11/397611
DATED : June 3, 2008
INVENTOR(S) : Hidehiko Kanda et al.

It is certified that error appears in the above-identified patent and that said Letters Patent is hereby corrected as shown below:

IN THE TITLE:
"IMAGING FORMING SYSTEM" should read --IMAGE FORMING SYSTEM--.

COLUMN 1:
Line 14, "ink a" should read --ink to a--.

COLUMN 2:
Line 4, "am" should read --an--; and
Line 28, "completed." should read --been completed.--.

COLUMN 5:
Line 31, "to" should be deleted.

COLUMN 14:
Line 23, "maybe" should read --may be--.

COLUMN 15:
Line 20, "dada" should read --data--.

Signed and Sealed this

Sixth Day of January, 2009

JON W. DUDAS
*Director of the United States Patent and Trademark Office*

UNITED STATES PATENT AND TRADEMARK OFFICE

CERTIFICATE OF CORRECTION

PATENT NO. : 7,380,900 B2
APPLICATION NO. : 11/397611
DATED : June 3, 2008
INVENTOR(S) : Hidehiko Kanda et al.

It is certified that error appears in the above-identified patent and that said Letters Patent is hereby corrected as shown below:

TITLE PAGE, IN THE TITLE, ITEM [54], LINE 1 AND COLUMN 1, LINE 1:
"IMAGING FORMING SYSTEM" should read --IMAGE FORMING SYSTEM--.

COLUMN 1:
Line 14, "ink a" should read --ink to a--.

COLUMN 2:
Line 4, "am" should read --an--; and
Line 28, "completed." should read --been completed.--.

COLUMN 5:
Line 31, "to" should be deleted.

COLUMN 14:
Line 23, "maybe" should read --may be--.

COLUMN 15:
Line 20, "dada" should read --data--.

This certificate supersedes the Certificate of Correction issued January 6, 2009.

Signed and Sealed this

Third Day of February, 2009

John Doll

JOHN DOLL
*Acting Director of the United States Patent and Trademark Office*